US006357381B1

(12) United States Patent
Lee

(10) Patent No.: US 6,357,381 B1
(45) Date of Patent: Mar. 19, 2002

(54) CONTROL LEVER FOR GENERATING A LEVEL SOUND

(75) Inventor: Chung-Ho Lee, Chullabuk-Do (KR)

(73) Assignee: Hyundai Motor Company (KR)

( * ) Notice: Subject to any disclaimer, the term of this patent is extended or adjusted under 35 U.S.C. 154(b) by 0 days.

(21) Appl. No.: 08/859,793

(22) Filed: May 19, 1997

(30) Foreign Application Priority Data

Jun. 15, 1996 (KR) ..... 96-21695

(51) Int. Cl.[7] ..... G08B 3/02

(52) U.S. Cl. ..... 116/67 R; 116/148; 116/169; 219/506; 165/11.1; 62/131

(58) Field of Search ..... 116/67 R, 141, 116/148, 169, 200, 280, 137 R, 140, 154, 155, 167, 172, 28.1, DIG. 20; 74/527, 473.27, 473.28, 473.1, 473.13, 532, 502.2; 84/402, 408, 409, 410; 219/202, 506; 340/384.1, 392.1, 392.2, 392.3, 398.1, 392.5; 165/11.1; 62/125, 131; 236/DIG. 1, 94

(56) References Cited

U.S. PATENT DOCUMENTS 2,880,640 A * 4/1959 Chaplar ..... 84/408
4,155,270 A * 5/1979 Juy ..... 116/67 R
4,270,481 A * 6/1981 Watarai ..... 116/28.1
4,454,784 A * 6/1984 Shimano ..... 116/67 R
4,582,251 A * 4/1986 Odom, Jr. et al. ..... 236/94
4,613,319 A * 9/1986 Nagano ..... 74/527
4,850,240 A * 7/1989 White ..... 74/527
4,905,537 A * 3/1990 Nagano ..... 74/531
5,690,277 A * 11/1997 Flood ..... 236/94

FOREIGN PATENT DOCUMENTS

JP 578848 10/1993

* cited by examiner

*Primary Examiner*—Andrew Hirshfeld
(74) *Attorney, Agent, or Firm*—Christie, Parker & Hale, LLP

(57) ABSTRACT

An improved control lever for generating a level sound which enables audible control of the control lever without looking at the control lever during the operation of a vehicle by generating a predetermined level sound in accordance with the position of the control lever, which includes a lever body hinged to a base and rotated within a predetermined operational range for controlling the operation of an apparatus, and a sound generating member for generating a predetermined different sound based on the position of the lever body within the operational range thereof.

2 Claims, 3 Drawing Sheets

FIG. 4
FIG. 4A
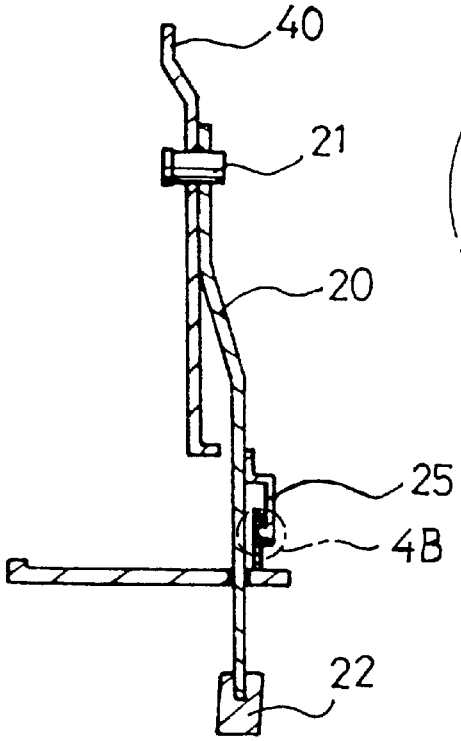
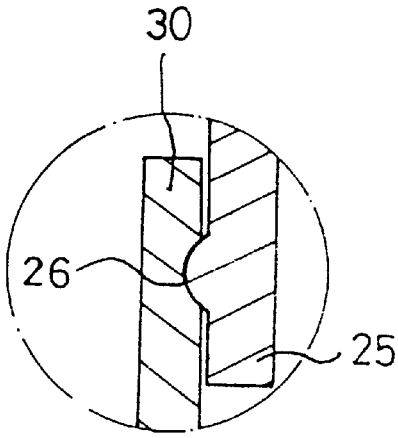
FIG. 4B

CONTROL LEVER FOR GENERATING A LEVEL SOUND

BACKGROUND OF THE INVENTION

1. Field of the Invention

The present invention relates to a control lever for generating a level sound, and in particular to an improved control lever for generating a level sound which generates an audible level sound when a user controls a control lever adapted for a predetermined apparatus such as a heater apparatus of a vehicle, an opening level control apparatus for an air conditioner, and the like, whereby a user can easily recognize the control level in accordance with a position of the control lever.

2. Description of the Conventional Art

Generally, the control lever is used for controlling the operation of a mechanical apparatus. Namely, the control lever is moved manually or automatically so as to control the opening level of an air conditioner, a heater apparatus for a vehicle, and the like in accordance with its moved position.

FIG. 1 is a plan view illustrating an operational panel of a heater control apparatus for a vehicle to which a conventional control lever is adapted, and FIG. 2 is a cross-sectional view taken along line II–II' of FIG. 1.

As shown therein, a control lever 1 is rotatable with respect to a support shaft 5 fixed to a base 11 by moving a knob 2 engaged to one lower end of the control lever 1. In addition, the control lever 1 includes an elongated hole 3 within which the support shaft 5 rotates and moves therealong. The control lever 1 further includes an engaging protrusion 4 which linearly moves along an elongated guide groove 6 formed in the base 11, for thus radially moving the control lever 1 along the guide groove 6 with respect to the support shaft 5.

In addition, a plate shape spring 8 having a protrusion 9 is disposed on the control lever 1. The protrusion 9 contacts with a plurality of embossed portions 12 formed in the base 11, so that the control force of the control lever 1 is evenly applied through the entire range of operation. In the embossed portions 12, the height at the intermediate position is higher than the height at both left and right positions.

However, the conventional control lever has the following disadvantages.

First, if the conventional control lever 1 is used in a vehicle, a vehicle driver must see the control lever 1 so as to control it while the vehicle is running. Namely, the car driver may loose his/her vehicle driving sensitivity for a minute while operating the control lever 1, thus causing an accident.

In addition, if a disabled person operates the control lever 1 adapted to various kinds of machines it's extremely difficult for him/her to properly and accurately control the machine.

SUMMARY OF THE INVENTION

Accordingly, it is an object of the present invention to provide a control lever for generating a level sound which overcomes the problems encountered in the conventional control lever.

It is another object of the present invention to provide an improved control lever for generating a level sound which generates an audible level sound when a user controls a control lever adapted for a predetermined apparatus such as a heater apparatus of a vehicle, an opening level control apparatus for an air conditioner, and the like, whereby a user can easily recognize the control level in accordance with a moved position of the control lever.

It is another object of the present invention to provide an improved control lever for generating a level sound which enables audible control of the control lever without seeing the control lever during the operation of a vehicle by generating a predetermined level sound in accordance with the position of the control lever.

To achieve the above objects, there is provided an improved control lever for generating a level sound which includes a lever body hinged to a base and rotated within a predetermined operational range for controlling the operation of an apparatus, and a sound generating member for generating a predetermined different sound based on the position of the lever body within the operational range thereof.

Additional advantages, objects and other features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The present invention will become more fully understood from the detailed description given hereinbelow and the accompanying drawings which are given by way of illustration only, and thus are not limited by the present invention, wherein:

FIG. 4 is a cross-sectional view taken along line IV–IV' of FIG. 3 according to the present invention.

DETAILED DESCRIPTION OF THE INVENTION

Figure 1:
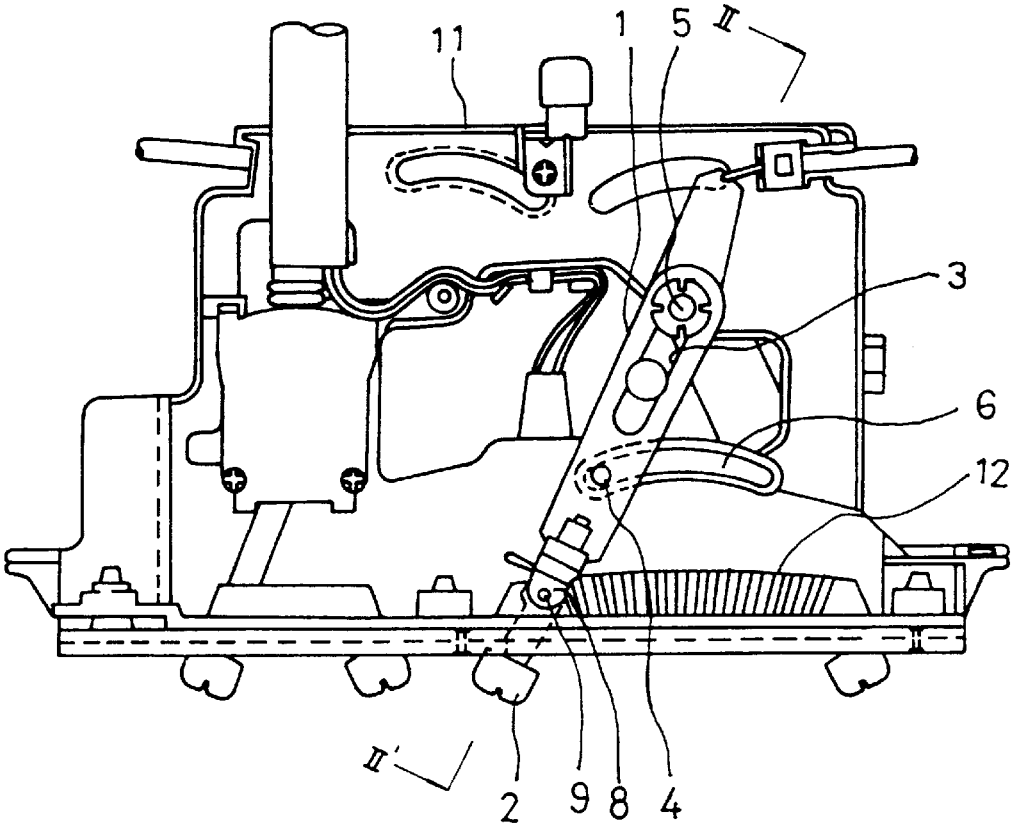
FIG. 1 (Conventional Art)
FIG. 1 is a plan view illustrating an operational panel of a heater control apparatus for a vehicle to which a conventional control lever is adapted.
Figure 2:
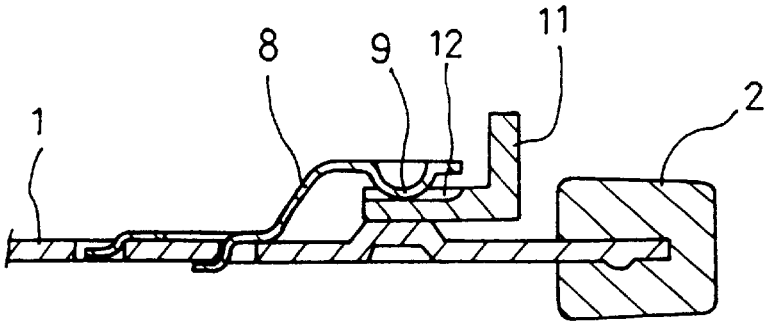
FIG. 2 (Conventional Art)
FIG. 2 is a cross-sectional view taken along line II–II' of FIG. 1.
Figure 3:
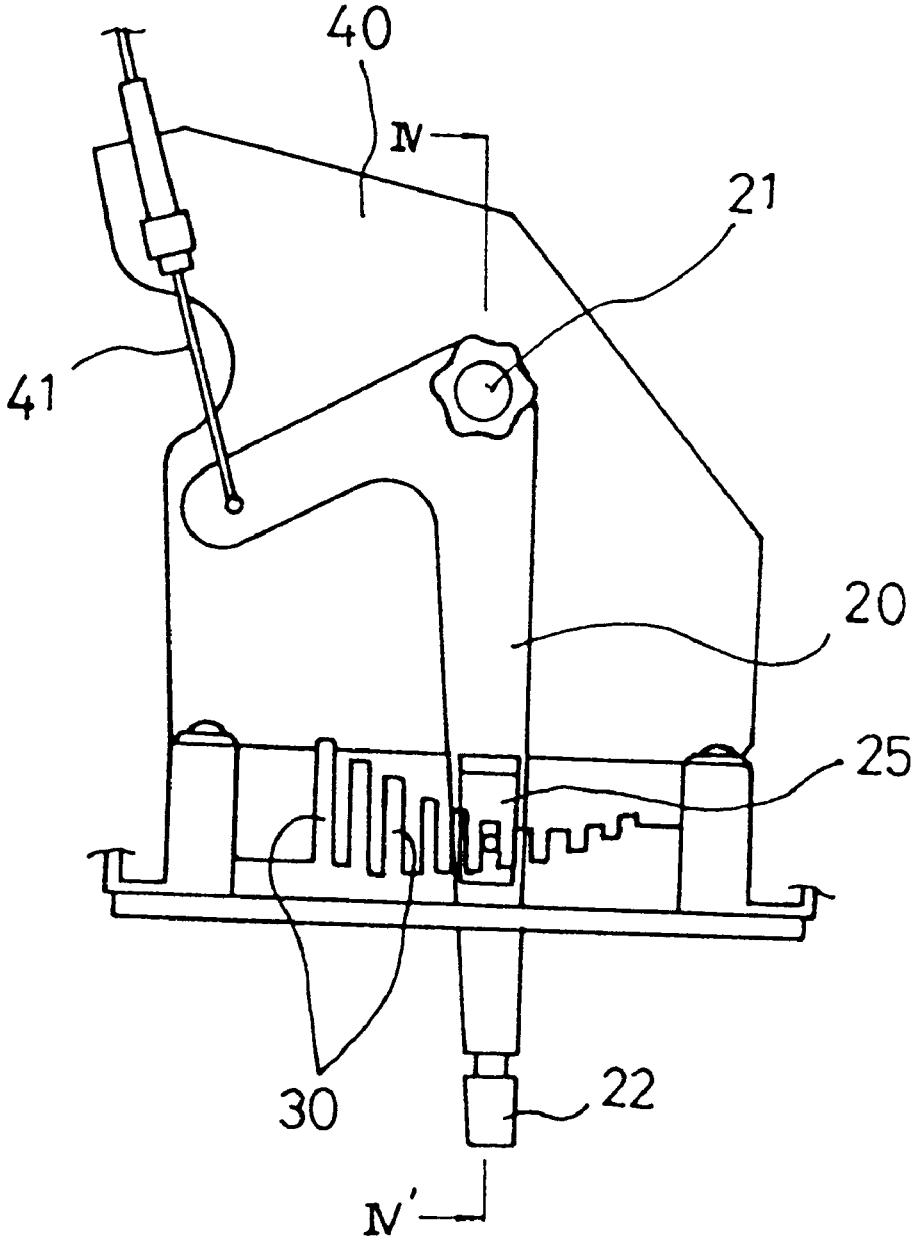
FIG. 3 is a plan view illustrating a control lever for generating a level sound according to the present invention, which is adapted to a heater control apparatus for a vehicle.

FIG. 3 is a plan view illustrating a control lever for generating a level sound according to the present invention, which is adapted to a heater control apparatus for a vehicle, and FIG. 4 is a cross-sectional view taken along line IV–IV' of FIG. 3 according to the present invention.

As shown therein, a lever body 20 is rotatable within a predetermined range with respect to a hinge shaft 21 fixed to a base 40. One end of the lever body 20 is connected to a cable 41 to control the operation of a heater. In addition, a knob 22 is disposed at a lower end of the lever body 20 which is exposed to the outside of a heater control apparatus.

In addition, a guide plate 25 is attached to an intermediate portion of the lever body 20, and a sounding protrusion 26 is formed in a lower portion of the guide plate 25 so as to generate a predetermined sound when the sounding protrusion 26 contacts with each of sounding plates 30 which will be described below.

Namely, a plurality of sounding plates 30 are disposed in a position mating with the moving path of the guide plate 25 on the lever body 20. The length of each sounding plate 30 is made gradually different with respect to its position, thereby generating a different sound when the lever body 20 moves along the sounding plates 30 in cooperation with the sounding protrusion 26.

The length of the sounding plates 30, as shown in FIG. 3, is shorter on one side than the other side in this embodiment. However, the length thereof may be shorter on either side. Generally, if the sounding plate 30 is shorter, a higher sound is generated thereby, and if the sounding plate 30 is longer, a lower sound is generated thereby.

The operation of the control lever for generating a level sound according to the present invention will now be explained with reference to FIGS. 3 and 4.

First, a driver or a user manually moves the knob 22 of the lever body 20 in a predetermined direction so as to control the heater. Namely, the operational level of the heater is controlled by moving the lever body 20 in a predetermined direction. For example, if the knob 22 is positioned in the leftmost position, the heater is in the highest operational level, and if the knob 22 is positioned in the rightmost position, the heater is in the lowest operational level.

When the lever body 20 rotates with respect to the hinge shaft 21, the sounding protrusion 26 formed in the guide plate 25 elastically contacts with the sounding plates 30. In more detail, when the sounding protrusion 26 elastically contacts with each of the sounding plates 30, a predetermined sound is generated therebetween. Namely, a different sound is generated based on the position of the lever body 20.

Therefore, when the lever body 20 is moved, and the position thereof is varied, a different sound is generated based on the position of the lever body 20, whereby a driver or a user can easily recognize the level of the heater.

As described above, the control lever for generating a level sound according to the present invention is directed to generating a level sound in accordance with the position of the control lever, so that a driver or a user can easily recognize the level of a heater or a levelling apparatus, thus preventing a car accident or malfunction of the apparatus. In particular, the control lever for generating a level sound according to the present invention is very useful for a disabled person because it is possible to audibly check the control level of the apparatus.

Although the preferred embodiments of the present invention have been disclosed for illustrative purposes, those skilled in the art will appreciate that various modifications, additions and substitutions are possible, without departing from the scope and spirit of the invention as recited in the accompanying claims.

What is claimed is:

1. A control lever for generating a level sound, comprising:

a lever body hinged to a base and rotatable within a predetermined operational range for controlling the operation of an apparatus;

a sound generating means for generating a predetermined different sound based on the position of the lever body within the operational range thereof, said sound generating means including:

a plurality of sounding plates formed parallel to one side of the base, each one of said sounding plates generating one of said predetermined different sounds; and a sounding protrusion formes in a guide plate on the lever body, said protrusion arranged to elastically contact the sounding plates for generating the predetermined different sounds when the lever body moves within the operational range.

2. The control lever of claim 1, wherein said plurality of sounding plates have gradually different lengths so as to generate series sounds.

* * * * *